US006633214B2

(12) United States Patent
Mochizuki

(10) Patent No.: US 6,633,214 B2
(45) Date of Patent: Oct. 14, 2003

(54) ELECTROMAGNETIC RELAY

(75) Inventor: Masahide Mochizuki, Chiba (JP)

(73) Assignee: Tyco Electronics EC K.K., Kanagawa (JP)

( * ) Notice: Subject to any disclaimer, the term of this patent is extended or adjusted under 35 U.S.C. 154(b) by 0 days.

(21) Appl. No.: 10/260,850

(22) Filed: Sep. 27, 2002

(65) Prior Publication Data

US 2003/0062977 A1 Apr. 3, 2003

(30) Foreign Application Priority Data

Oct. 1, 2001 (JP) ..... 2001-305621

(51) Int. Cl.[7] ..... H01H 67/02
(52) U.S. Cl. ..... 335/128; 335/78
(58) Field of Search ..... 335/128

(56) References Cited

U.S. PATENT DOCUMENTS

| | | | | |
|---|---|---|---|---|
| 4,405,911 A | | 9/1983 | Hasegawa et al. | 335/202 |
| 4,491,813 A | * | 1/1985 | Kimpel et al. | 335/187 |
| 4,688,010 A | * | 8/1987 | Nobutoki et al. | 335/128 |
| 4,914,411 A | * | 4/1990 | Hikita et al. | 335/128 |
| 5,191,306 A | | 3/1993 | Kaji et al. | 335/78 |
| 5,696,475 A | * | 12/1997 | Yoshitani et al. | 335/78 |
| 5,880,655 A | * | 3/1999 | Dittmann et al. | 335/78 |
| 6,246,306 B1 | | 6/2001 | Gruner | 335/83 |

FOREIGN PATENT DOCUMENTS

| | | | |
|---|---|---|---|
| JP | 01302631 | 6/1989 | H01H/50/18 |
| JP | 3011334 | 12/1999 | H01H/50/64 |

* cited by examiner

*Primary Examiner*—Elvin Enad
*Assistant Examiner*—Bernard Rojas
(74) *Attorney, Agent, or Firm*—Barley, Snyder

(57) ABSTRACT

Electromagnetic relay having an increased insulating distance between a primary side circuit consisting of an excitation coil and an armature and a secondary side circuit consisting of a movable contact and a fixed contact, so that the withstand voltage of the relay is increased in comparison to prior art electromagnetic relays. The electromagnetic relay includes a base housing having a first insulating wall extending between the excitation coil and the armature, and a second insulating wall separating the movable and fixed contacts and the armature. An operating part of the relay presses the movable contact via a hole formed in substantially the central portion of the second insulating wall of the base housing.

10 Claims, 8 Drawing Sheets

ELECTROMAGNETIC RELAY

FIELD OF THE INVENTION

The present invention relates generally to an electromagnetic relay, and more particularly to a compact electromagnetic relay that is mounted on a circuit board.

BACKGROUND OF THE INVENTION

In the prior art, Japanese Patent Application Kokoku No. H4-42766 describes a conventional electromagnetic relay, which is shown in FIG. 7.

The electromagnetic relay comprises an insulating base housing 110, a contact part 120, an operating electromagnet 130 and a case 140.

The base housing 110 is formed with wall members 115 and 116 protruding on both ends of a substantially rectangular body that extends in a longitudinal direction, and includes insertion holes 111 and 112 formed in the front sides of the respective wall members 115 and 116 (toward the front in FIG. 5). Insertion parts 131*a* (only one insertion part 131*a* is shown in FIG. 5) on a gate-form iron core 131 are each press-fitted into a respective one of the insertion holes 111,112. A circular receiving hole 113 is formed in close proximity to a corner of the insertion hole 111 on the side of the wall member 115 and receives a leg 133*d* of an armature 133. In addition, a receiving groove 114 is formed in close proximity to a corner of the insertion hole 112 on the side of the wall member 116 and receives a protrusion 133*f* of the armature 133 and regulates the pivoting range of the armature 133. A pair of through-holes 117 are formed in the wall member 116 and allow the passage of coil terminals 135.

The contact part 120 comprises a fixed contact 121 and a movable contact 123. The fixed contact 121 and movable contact 123 have a fixed contact point 122 and a movable contact point 124, respectively, on facing surfaces, and have board connecting portions (not shown) that are connected to a circuit board (not shown). The fixed contact 121 and movable contact 123 are formed by stamping and forming copper alloy plates consisting of phosphorus bronze, etc. The fixed contact 121 and movable contact 123 are fastened to the wall member 115 of the base housing 110 so that they are arranged beneath the excitation coil 134 and between the two legs 131*b* of the gate-form iron core 131.

The operating electromagnet 130 comprises a gate-form iron core 131, a winding frame 132 fastened to the gate-form iron core 131 by press-fitting, an armature 133, and an excitation coil 134.

The gate-form iron core 131 is formed in the shape of a gate-form flat plate with a body (not shown) extending in the horizontal direction and a pair of legs 131*b* (only one leg 131*b* is shown) extending downward from both ends of the body. The core 131 is formed by stamping an iron core. Insertion parts 131*a,* press-fitted in the insertion holes 111 and 112, protrude from the lower ends of the legs 131*b* of the gate-form iron core 131. A projection 131*c* is formed on an upper portion of one end of the gate-form iron core 131.

The winding frame 132 comprises a winding body (not shown) with a U-shaped cross section which extends in the horizontal direction and which has a U-shaped groove open at the top, flanges 132*a* arranged on both ends of the winding body, and a terminal 132*b* which extends to one side as a continuation of one of the flanges 132*a*. The winding frame 132 is formed by molding an insulating synthetic resin. The body of the gate-form iron core 131 is press-fitted in the U-shaped groove of the winding body of the winding frame 132, so that the gate-form iron core 131 and the winding frame 132 are formed into an integral unit. Two coil terminals 135 are fastened to the terminal 132*b*. The excitation coil 134 is wound around the circumference of the winding body of the winding frame 132, and the ends of the excitation coil 134 are connected to a respective one of the coil terminals 135.

The armature 133 is constructed with an inverted gate shape by stamping an iron plate, and comprises a horizontal portion 133*a* extending in the horizontal direction, and a pair of vertical portions 133*b* and 133*c* extending upward from both ends of the horizontal portion 133*a*. A leg 133*d* acts as a support for the armature 133 and protrudes from a lower end of the vertical portion 133*b* on one end of the armature 133. A protrusion 133*f*, used to regulate the pivoting range of the armature 133, protrude from the lower end of the vertical portion 133*c* on the other end of the armature 133. A recess 133*e*, mated with the projection 131*c* of the gate-form core 131, is formed in the upper end of the vertical portion 133*b* on one end of the armature 133 on the axial line of the leg 133*d*. An insulating operating part 133*g* is mounted on the horizontal portion 133*a* of the armature 133.

The operating electromagnet 130, constructed as described above, is installed on the base housing 110 by press-fitting both insertion parts 131*a* of the gate-form iron core 131 in the insertion holes 111 and 112, inserting the leg 133*d* of the armature 133 into the receiving hole 113 of the base housing 110, and inserting the protrusion 133*f* into the receiving groove 114. At the same time, the coil terminals 135 are passed through the through-holes 117 in the base housing 110. In this manner, the leg 133*d* is supported in the receiving hole 113, and the recess 133*e* on the axial line of the leg 133*d* engages with the projection 131*c*. In view of this assembly, the armature 133 can pivot about the leg 133*d* and the recess 133*e* on the axial line of the leg 133*d*. The armature 133 receives a spring force via the operating part 133*g* from the movable contact 123, which also acts as a return spring, so that in the non-excited state of the excitation coil 134, the vertical portion 133*c* on the second end of the armature 133 is separated from the gate-form iron core 131. On the other hand, when the excitation coil 134 is excited, the vertical portion 133*c* on the second end of the armature 133 pivots about the leg 133*d* and the recess 133*e* located on the axial line of the leg 133*d,* and is caused to adhere to the gate-form iron core 131. As a result, the movable contact 123 is pressed so that it undergoes elastic deformation, thus causing the contact points 122 and 124 to close.

The case 140 is a substantially rectangular member with an accommodating space (not shown) formed inside that covers the base housing 110 and the operating electromagnet 130 installed on the base housing 110. The case 140 covers the base housing 110 and operating electromagnet 130, and is anchored to the base housing 110. A projection (not shown) is arranged in the accommodating space of the case 140 to press against the upper end on the side of the projection 131*c* of the gate-form iron core 131 and another projection (not shown) is arranged in the accommodating space to prevent the upper end of the vertical portion 133*b* on the pivoting fulcrum side (first end) of the armature 133 from tilting when the base housing 110 and operating electromagnet 130 are covered.

The electromagnetic relay constructed as described above provides an ultra-compact magnetic relay inexpensively and with high productivity.

Another conventional electromagnetic relay is shown in FIG. 8 and is described more fully in Japanese Patent No. 3011334. The electromagnetic relay has an operating electromagnet comprising a gate-form iron core 231 which has a body 231*a* extending in a horizontal direction and first and second legs 231*b* and 231*c* each extending from a respective end of the body 231*a*, an insulating winding frame 232 which is attached to the body 231*a* and around the circumference of which an excitation coil 234 is wound, and an armature 233. The armature 233 has a horizontal portion 233*a* which extends in the horizontal direction and on which an insulating operating part 235 is arranged, a pivoting shaft 233*b* which extends from one end of the horizontal portion 233*a* in the direction of extension of the first leg 231*b*, and a vertical portion 233*c* which extends from the other end of the horizontal portion 233*a*, and which contacts the second leg 231*c* when the excitation coil 234 is excited. The operating electromagnet is received inside an insulating base housing 210. When the armature 233 is received in the base housing 210, the armature 233 is guided by a guide wall 211 protruding from the base housing 210. A movable contact 221 and a fixed contact 222 are fastened to the base housing 210 so that they are arranged on one side of the excitation coil 234 (on the front side in FIG. 8) between the first and second legs 231*b* and 231*c* of the gate-form iron core 231.

The armature 233 receives a spring force via a protrusion 235*a* of the operating part 235 from the movable contact 221, which also acts as a return spring, so that the vertical portion 233*c* located on the side of the second end of the armature 233 is separated from the gate-form iron core 231 when the excitation coil 234 is in a non-excited state. On the other hand, when the excitation coil 234 is excited, the vertical portion 233*c* located on the side of the second end of the armature 233 pivots about the pivoting shaft 233*b* and adheres to the gate-form iron core 231. As a result, the movable contact 221 is pressed so that it undergoes elastic deformation, thus causing a contact point of the movable contact part 221 and a contact point of the fixed contact 222 to close.

The base housing 210 and the operating electromagnet arranged on the base housing 210 are covered by a case 240.

Reference numeral 236 in FIG. 8 designates a hinge spring which is used to press the pivoting shaft 233*b* of the armature 233 against the gate-form iron core 231.

However, the following problems have been encountered in these conventional electromagnetic relays.

In the electromagnetic relay shown in FIG. 7 (that of Japanese Patent Application Kokoku No. H4-42766), only the operating part (insulating part) 133*g* fastened to the armature 133 is present between the excitation coil 134 and armature 133 on the one hand, and the movable and fixed contacts 123 and 121 on the other hand. Accordingly, the insulating distance between the primary side circuit consisting of the excitation coil 134 and armature 133 and the secondary side circuit consisting of the movable and fixed contacts 123 and 121 is small so that as a result, the withstand voltage is low.

In the electromagnetic relay shown in FIG. 8 (that of Japanese Patent No. 3011334), a guide wall 211 consisting of an insulating material is present between the excitation coil 234 and the movable and fixed contacts 221 and 222. However, only the operating part 235 fastened to the armature 233 is present between the armature 233 and the movable and fixed contact 221 and 222. As a result, the insulating distance between the armature 233 and the movable and fixed contacts 221 and 222 is extremely small.

SUMMARY OF THE INVENTION

Accordingly, it is an object of the present invention is to provide an electromagnetic relay which avoids the above-mentioned problems and makes it possible to increase the insulating distance between the primary side circuit consisting of the excitation coil and armature, and the secondary side circuit consisting of the movable and fixed contacts, so that the withstand voltage can be increased.

An electromagnetic relay in accordance with the present invention comprises a substantially C-shaped flat-plate-form yoke which has a body extending in a horizontal direction and first and second legs extending downward from both ends of the body, and an insulating winding frame which has a winding body attached to the body of the C-shaped flat-plate-form yoke, and which has an excitation coil wound around the circumference of the winding body. The electromagnetic relay also includes an armature having a horizontal portion which extends in the horizontal direction, and on which an insulating operating part is arranged, a pivoting shaft extending from one end of the horizontal portion in the direction of extension of the first leg, and a vertical portion which extends from the other end of the horizontal portion, and which contacts the second leg when the excitation coil is excited. An insulating base housing supports both of the first and second legs of the yoke, and has a recess or hole that receives a shaft portion formed on the lower end of the pivoting shaft of the armature. A movable contact and a fixed contact are attached to the base housing and contact each other as a result of the pressing of the operating part. The base housing has a first insulating wall extending between the excitation coil and the armature and has a second insulating wall that blocks the space between the movable and fixed contacts and the armature. The operating part presses the movable contact via a hole formed in substantially the central portion of the second insulating wall.

As used herein, the term "substantially C-shaped" includes shapes having corners.

BRIEF DESCRIPTION OF THE DRAWINGS

The invention will now be described by way of example with reference to the accompanying figures of which.

DETAILED DESCRIPTION OF THE PREFERRED EMBODIMENTS

Figure 1:
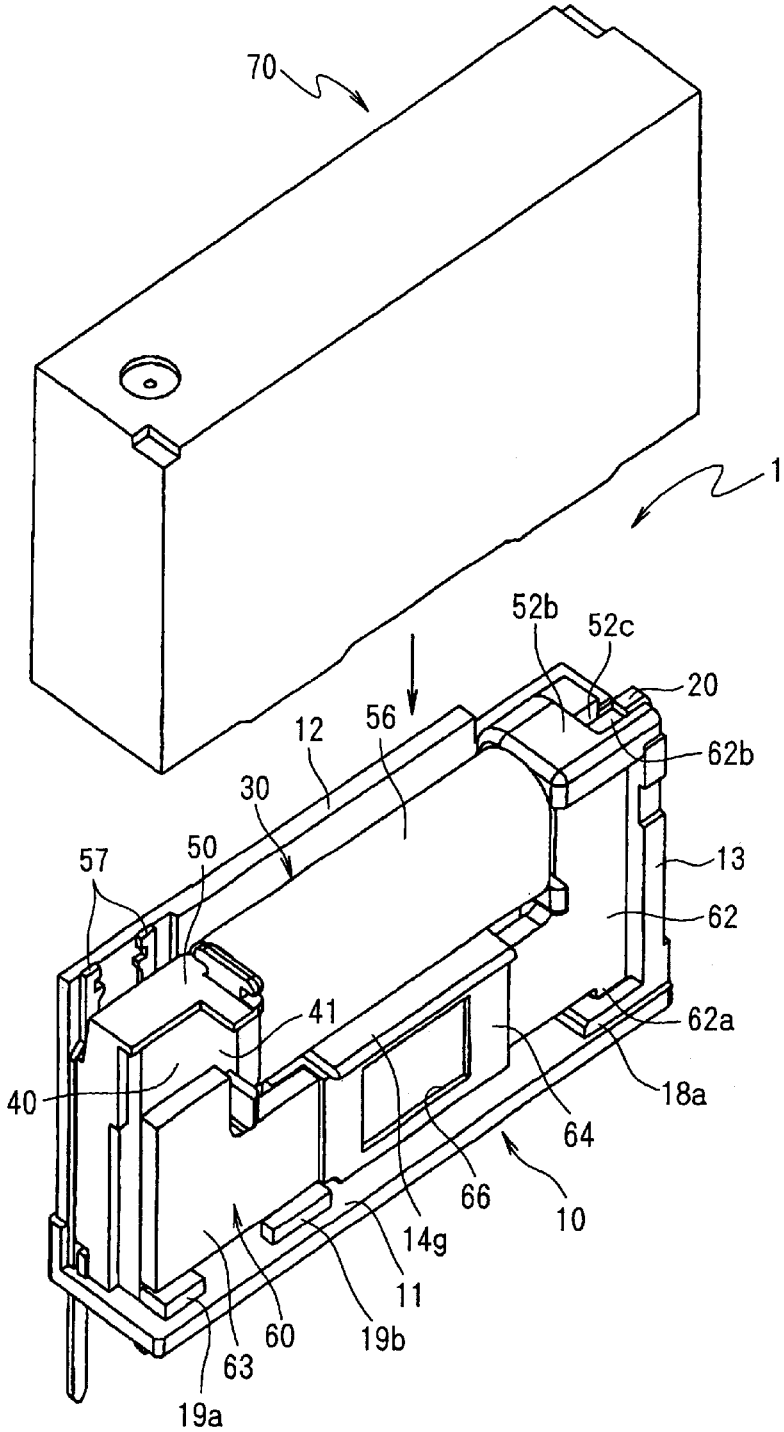
FIG. 1 is an exploded, front perspective view of an electromagnetic relay according to the present invention showing a base housing disengaged from an operating electromagnet.

An electromagnetic relay in accordance with the invention is shown in FIGS. 1–4 and is designated generally at 1.

The electromagnetic relay 1 comprises an insulating base housing 10, an operating electromagnet 30 arranged on the base housing 10 and a case 70 covering the base housing 10 and electromagnet 30. A movable contact 21 and a fixed contact 22 are attached to the base housing 10.

The operating electromagnet 30 comprises a flat-plate-form yoke or heel piece 40, a winding frame 50 and an armature 60.

The flat-plate-form yoke 40 of the operating electromagnet 30 is substantially C-shaped and has a rectangular body 41 extending in a horizontal direction, and a pair of rectangular first and second legs 42 and 43 extending downward from both ends of the body 41. The yoke 40 is formed by stamping an iron plate. The yoke 40 includes a projection or protrusion 42*a* protruding to the right (as shown in FIG. 2) and which is formed on the right edge of the upper end of the first leg 42 (the right-side leg in FIG. 2).

Figure 2:
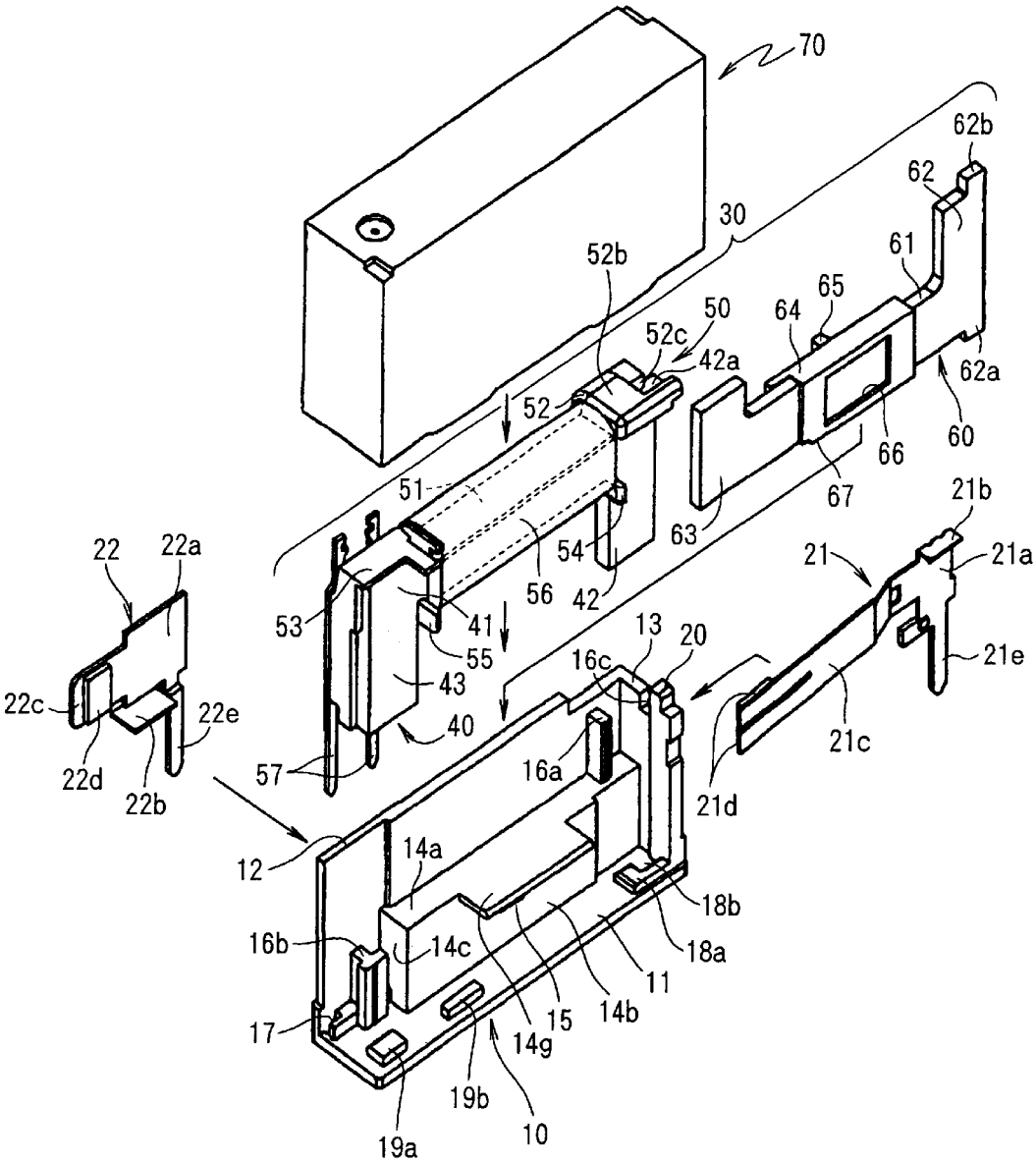
FIG. 2 is an exploded, front perspective view of the electromagnetic relay according to the present invention.

The winding frame 50 comprises a winding body 51 attached to the body 41 of the flat-plate-form yoke 40 so that the upper and lower edges and back surface (rear side in FIG. 2) of the body 41 are covered by the winding body 51, an extension 52 which extends from the right end of the winding body 51 toward the back surface of the first leg 42 (as shown in FIG. 2), and a terminal 53 which extends from the left end of the winding body 51 toward the back surface of the second leg 43. The winding frame 50 is formed by molding an insulating synthetic resin.

An excitation coil 56 is wound around the circumference of the winding body 51, and the ends of the excitation coil 56 are connected to a respective one of a pair of coil terminals 57 fastened to the back surface of the terminal 53. Flanges 54 and 55 are formed on the left and right ends of the winding body 51, respectively, to prevent positional deviation of the excitation coil 56 in the horizontal direction. The extension 52 has a back surface 52*a* positioned on the side of the back surface of the first leg 42, and an upper portion 52*b* extending from the upper end of the back surface 52*a* so that the upper portion 52*b* is positioned above the first leg 42.

A recess 52*c* is formed in the upper portion 52*b* and extends parallel to the direction of extension of the body 41 of the flat-plate-form yoke 40. The recess 52*c* opens on the side of the right end of the upper portion 52*b* (see FIG. 2). An extension-side guiding recess 52*d* is formed in the back surface 52*a* of the extension 52 and opens downward, and a terminal-side guiding recess 53*a* is formed in the back surface of the terminal 53 and opens downward.

The armature 60 is substantially C-shaped flat-plate-form and has a horizontal portion 61 extending in the horizontal direction, a pivoting shaft 62 extending from the right end of the horizontal portion 61 in the direction of extension of the first leg 42, and a vertical portion 63 extending from the left end of the horizontal portion 61 in the direction of extension of the second leg 43 (see FIG. 2). The armature 60 is formed by stamping an iron plate. An insulating operating part 64 covers the circumference of the horizontal portion 61, except for an opening portion 66, and is attached to the horizontal portion 61. A projection 65 protrudes from the back surface of the operating part 64 and is arranged to press the elastic spring 21*c* of the movable contact 21 to urge the movable contact 21 into contact with the fixed contact 22.

A rectangular shaft portion 62*a* protrudes from the lower end of the pivoting shaft 62 and is received in a recess 18*b* formed in the base housing 10 A rectangular projection 62*b* protrudes upward from the upper end of the pivoting shaft 62 on the axial line of the rectangular shaft 62*a* and is arranged inside a space defined by the recess 52*c* formed in the winding frame 50 and the protrusion 20 of the base housing 10. Since the rectangular shaft portion 62*a* is supported in the recess 18*b*, and the rectangular projection 62*b* located on the axial line of the rectangular shaft portion 62*a* is supported in the space defined by the recess 52*c* formed in the winding frame 50 and the protrusion 20 of the base housing 10, the armature 60 can pivot about the rectangular shaft portion 62*a* and rectangular projection 62*b*.

The armature 60 receives a spring force from the elastic spring 21*c* of the movable contact 21, which also acts as a return spring via the operating part 64, so that the vertical portion 63 on the side of the second end of the armature 60 is separated from the second leg 43 of the flat-plate-form yoke 40 in a state in which the excitation coil 56 is not excited. On the other hand, when the excitation coil 56 is excited, the vertical portion 63 on the side of the second end of the armature 60 pivots about the rectangular shaft portion 62*a* and the rectangular projection 62*b* and contacts the second leg 43.

Figure 4:
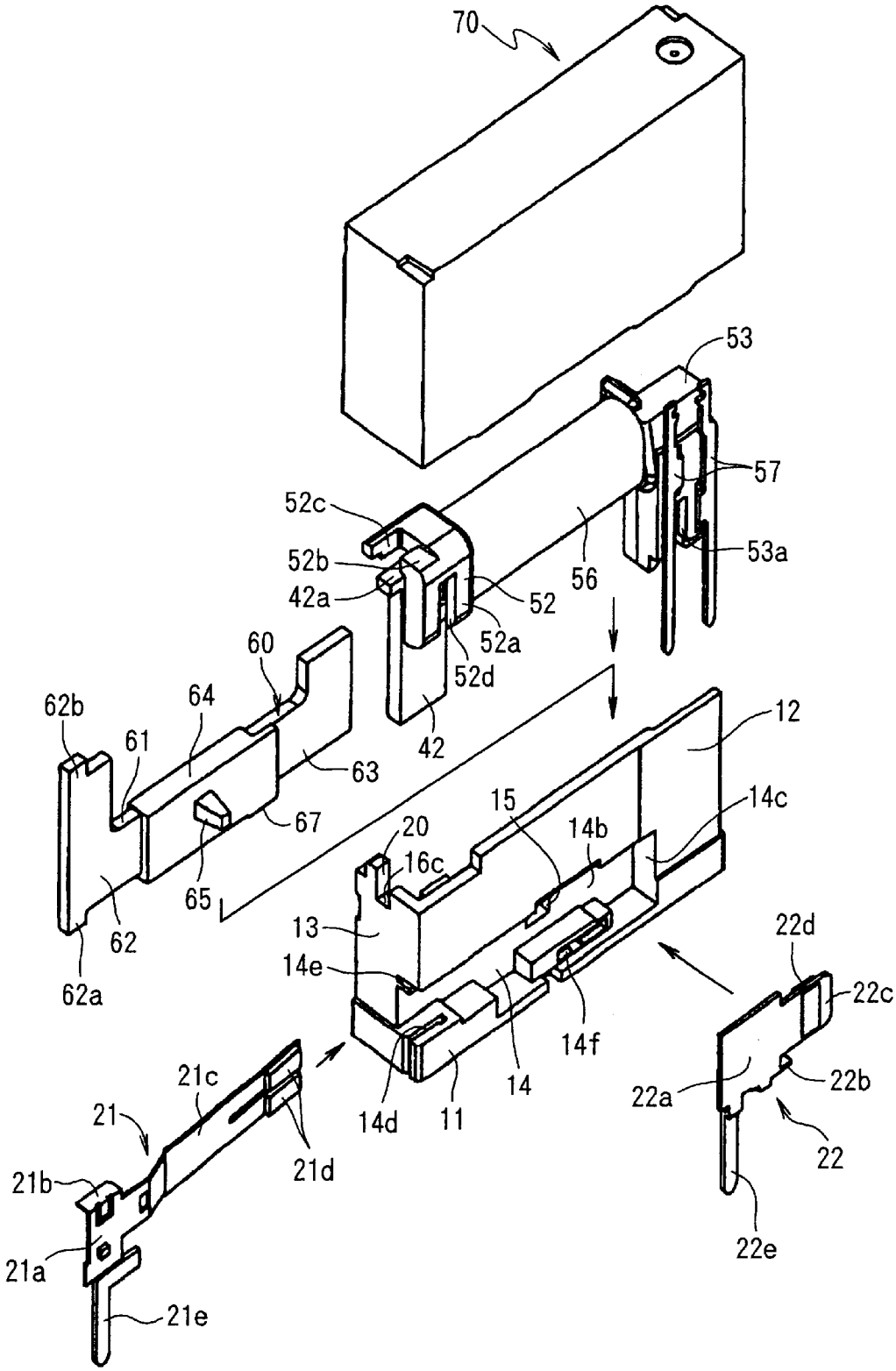
FIG. 4 is an exploded, rear perspective view of the electromagnetic relay according to the present invention.
Figure 5:
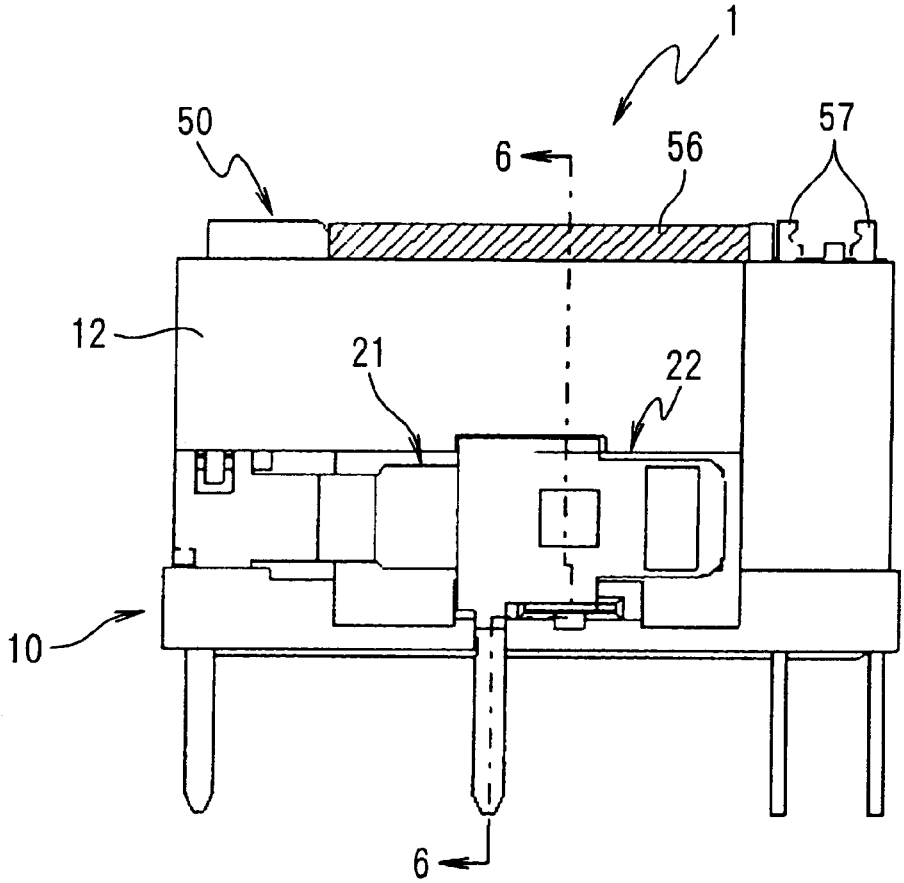
FIG. 5 is a rear view of the electromagnetic relay according to the present invention.

As shown most clearly in FIGS. 2 and 4, the base housing 10 comprises a substantially rectangular plate 11 extending in the longitudinal direction, a rear wall 12 extending from the rear edge (the edge on the rear side in FIG. 2) of the substantially rectangular plate 11, and an end wall 13 extending from the right-end edge (the edge of the right-side end portion in FIG. 2) of the substantially rectangular plate 11. The base housing 10 is formed by molding an insulating synthetic resin.

A contact-accommodating space 14 is formed to face forward from substantially the lower half of the rear wall 12 of the base housing 10 and opens in a portion of the end wall 13. The contact-accommodating space 14 accommodates the movable contact 21 and fixed contact 22, and is defined by a forward extension wall 14*a* extending forward from the rear wall 12, a front wall 14*b* connecting the front-end edge of the forward extension wall 14*a*, the substantially rectangular plate 11 and the end wall 13, as well as a side wall 14*c* connecting the left-end edge of the forward extension wall 14*a*, the left-end edge of the front wall 14*b*, the substantially rectangular plate 11 and the rear wall 12.

Figure 6:
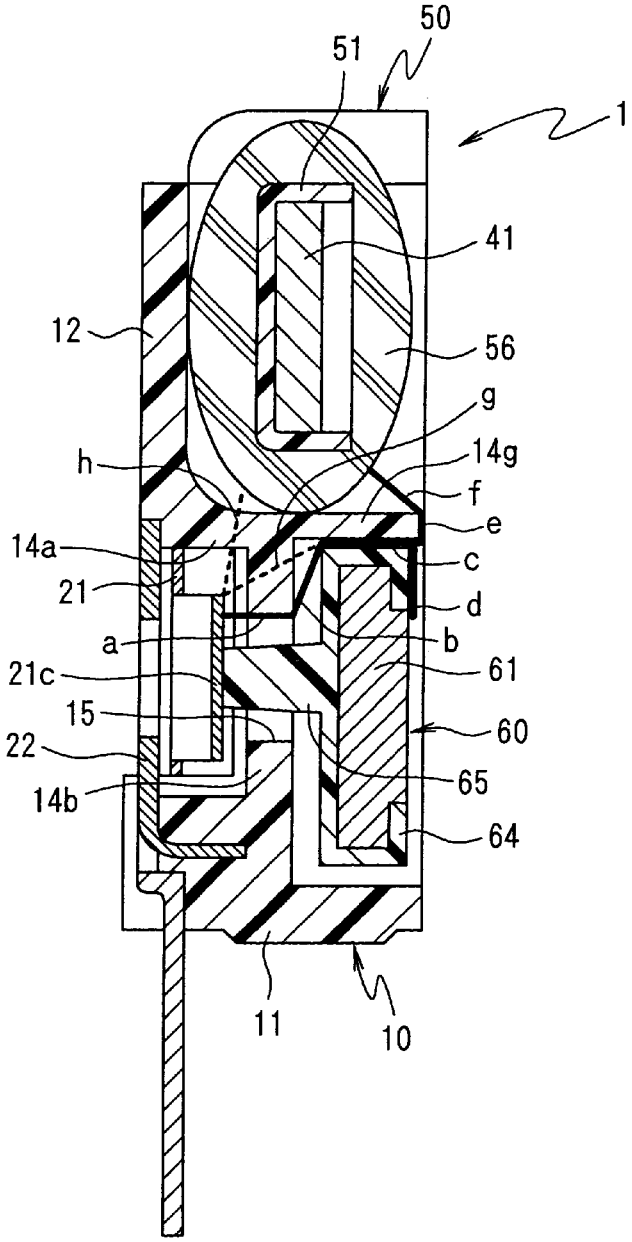
FIG. 6 is a sectional view taken along the line 6—6 in FIG. 5.
Figure 7:
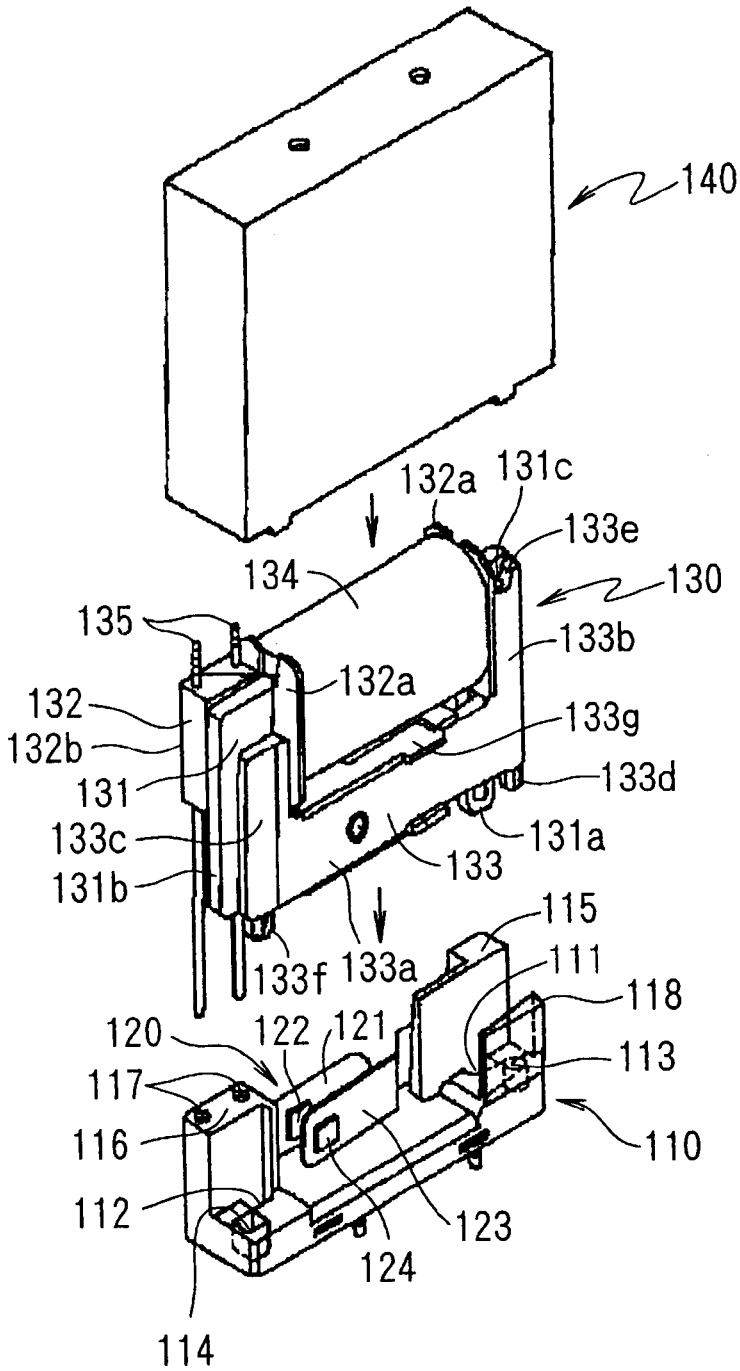
F I G. 7 Prior Art
FIG. 7 is an exploded perspective view of a prior art electromagnetic relay.
Figure 8:
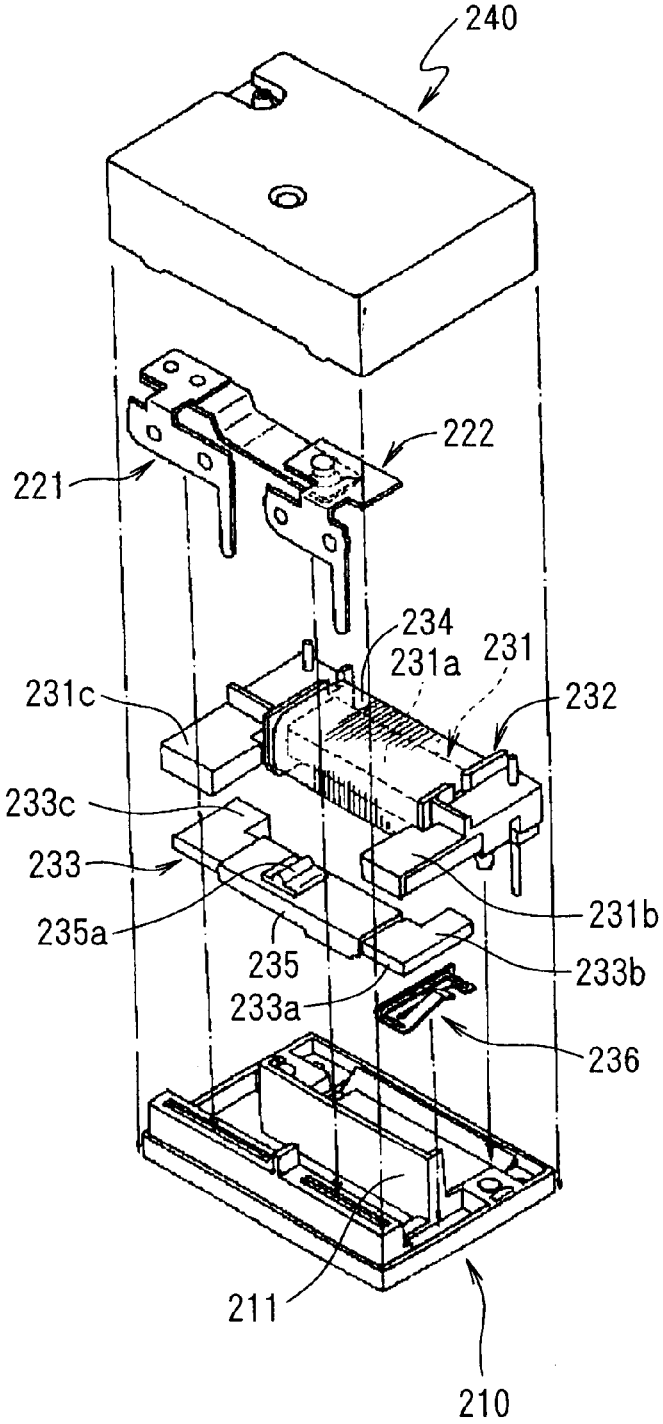
F I G. 8 Prior Art
FIG. 8 is an exploded perspective view of another prior art electromagnetic relay.

As shown in FIGS. 2 and 6, the forward extension wall 14*a* protrudes further forward than the front wall 14*b*, and has an insulating wall 14*g* extending between the excitation coil 56 and the horizontal portion 61 of the armature 60.

Further, as shown in FIG. 6, the front, insulating wall 14*b* is constructed to block the space between the movable and fixed contacts 21 and 22 and the armature 60, i.e., separate the movable and fixed contacts 21 and 22 from the armature 60. A rectangular hole 15 is formed in substantially the central portion of the front wall 14*b* and allows the projection 65 of the operating part 64 to pass through and press against the elastic spring 21*c* of the movable contact 21.

A rail 16*a* protrudes from the front surface of the right-end side of the rear wall 12 above the forward extension wall 14*a*. The rail 16*a* guides, the extension-side guiding recess 52*d* of the winding frame 50 when the assembly of the flat-plate-form yoke 40 and winding frame 50 is arranged on the base housing 10. In addition, a rail 16*b* protrudes from the front surface of the left-end side of the rear wall 12 and guides the terminal-side guiding recess 53*a* of the winding frame 50. A pair of through-holes 17 (only one of which is shown in FIGS. 1–4) is formed on the sides of the rail 16*b* on the left-end side of the substantially rectangular plate 11 and the coil terminals 57 are passed through the through-holes 17.

A substantially L-shaped protrusion 18*a* extends from the end wall 13 to cover the front of the substantially rectangular plate 11 and protrudes in the vicinity of the front edge on the right-end side of the substantially rectangular plate 11. The area surrounded by the L-shaped protrusion 18*a* defines the recess 18*b* that receives the rectangular shaft portion 62*a* located at one end of the armature 60. A support 19*a* protrudes in the vicinity of the front edge on the left-end side of the substantially rectangular plate 11. The support 19*a* positions and supports the legs 42 and 43 of the flat-plate-form yoke 40 together with the L-shaped protrusion 18*a*. The protruding strip 19*b* adjacent to the support 19*a* abuts against a projection 67 on the lower end of the operating part 64, and thus determines the pivoting range of the armature 60.

Figure 3:
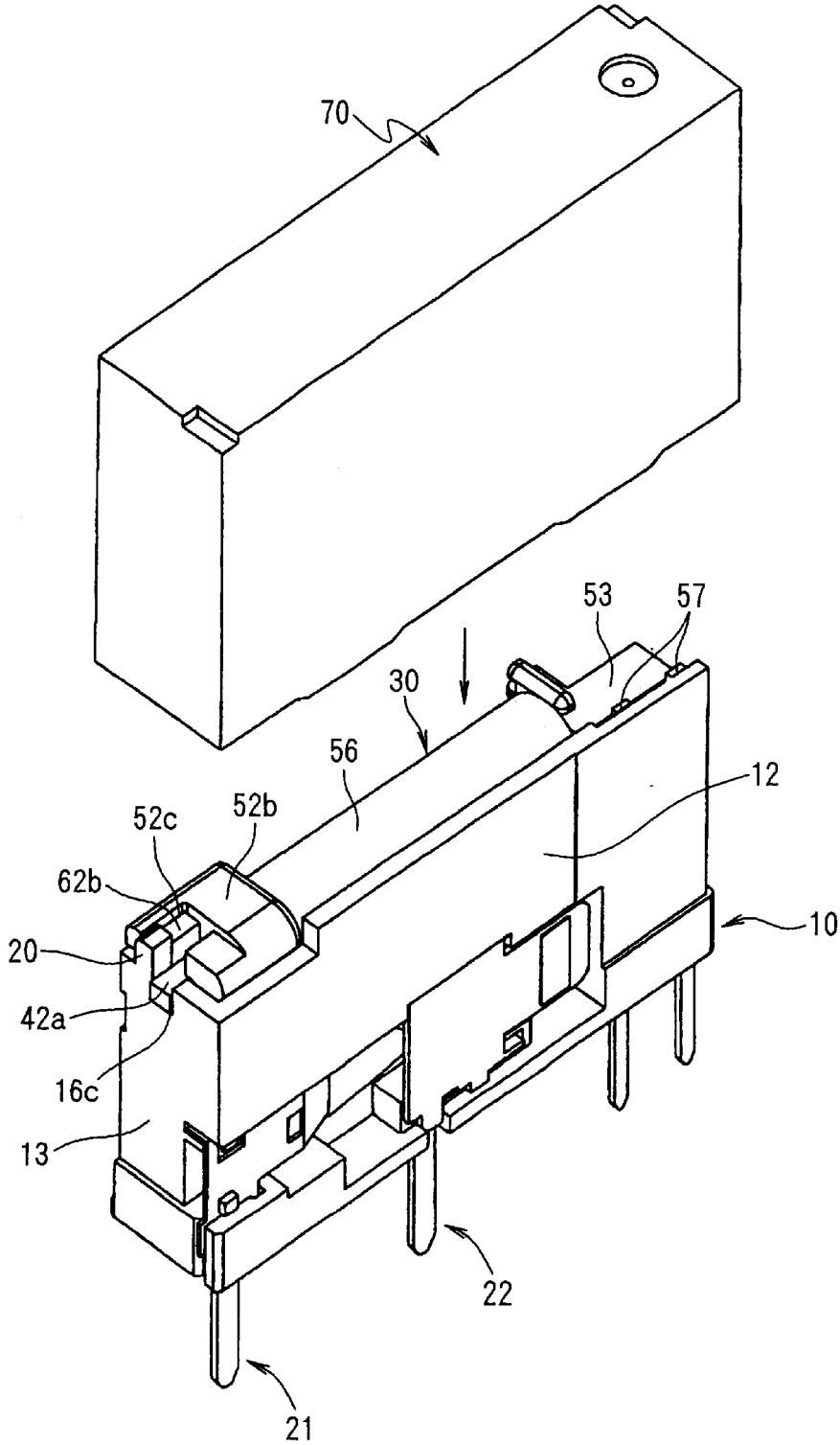
FIG. 3 is an exploded, rear perspective view of an electromagnetic relay according to the present invention showing the base housing disengaged from the operating electromagnet.

A recess 16*c* is formed in the upper end of the end wall 13 of the base housing 10 and receives the protrusion 42*a* of the attached flat-plate-form yoke 40. A protrusion 20 protrudes on the front side of the recess 16*c* and extends upward in the vicinity of the first leg 42 of the flat-plate-form yoke 40. As shown in FIGS. 1 and 3, the protrusion 20 is positioned on the front side inside the recess 52*c* of the winding frame 50 when the assembly of the flat-plate-form yoke 40 and winding frame 50 is arranged on the base housing 10, so that a space is formed by the recess 52*c* and protrusion 20 that can accommodate the rectangular projection 62*b*.

As shown most clearly in FIGS. 2 and 4, the movable contact 21 has a base 21*a* which is press-fitted in a press-fitting groove 14*d* formed in the substantially rectangular plate 11 beneath the contact-accommodating space 14. The press-fitting groove 14*d* extends leftward (rightward in FIG. 4) from the side of the end wall 13. The movable contact 21 is formed by stamping and forming a copper alloy plate consisting of phosphorus bronze, etc. A fastening portion 21*b* is formed by bending the upper end of the base 21*a* and is press-fitted in a separate press-fitting groove 14*e* formed in the rear wall 12 above the contact-accommodating space 14. The groove 14*e* extends leftward from the side of the end wall 13. A board connecting portion 21*e* to be connected to a circuit board (not shown) protrudes downward on the lower end of the base 21*a*.

An elastic spring 21*c*, which has a movable contact point 21*d* on the rear surface of the tip end, extends leftward from the left-end edge of the base 21*a*. The elastic spring 21*c* extends obliquely forward from the left-end edge of the base 21*a*, and is then bent so that it extends along the front wall 14*b* of the contact-accommodating space 14 in close proximity to the front wall 14*b*.

The fixed contact 22 has a base 22*a*, and is formed by stamping and forming a copper alloy plate consisting of phosphorus bronze, etc. A fastening portion 22*b* is formed by bending the lower end of the base 22*a* and is press-fitted in a press-fitting groove 14*f* positioned beneath the approximate center (with respect to the left-right direction) of the contact-accommodating space 14.

A board connecting portion 22*e*, which is connected to the circuit board, protrudes downward on the lower end of the base 22*a*. A flat-plate portion 22*c*, which has a fixed contact point 22*d* on the surface facing the movable contact point 21*d*, extends leftward from the left-end edge of the base 22*a*. When the fixed contact 22 is fastened to the base housing 10 (with the excitation coil 56 in a non-excited state), the flat-plate portion 22*c* is maintains a specified gap between the flat-plate portion 22*c* and the elastic spring 21*c* of the movable contact 21, so that the fixed contact point 22*d* and movable contact point 21*d* are separated from each other. When the excitation coil 56 is excited so that the vertical portion 63 on the side of the second end of the armature 60 contacts the second leg 43 on the second end of the flat-plate-form yoke 40, the projection 65 located on the back surface of the operating part 64 presses against the elastic spring 21*c* of the movable contact 21 via the rectangular hole 15, so that the elastic spring 21*c* is elastically deformed, thus causing the movable contact point 21*d* to contact the fixed contact point 22*d*.

The case 70 is a substantially rectangular member inside which an accommodating space (not shown) is formed. The accommodating space is designed to cover the base housing 10 and the operating electromagnet 30 arranged on the base housing 10. The case 70 is formed by molding an insulating synthetic resin.

To assemble the electromagnetic relay 1 constructed as described above, the armature 60 is first installed on the base housing 10 to which the movable contact 21 and fixed contact 22 have been fastened. In this installation, the rectangular shaft portion 62*a* located at one end of the armature 60 is inserted into the recess 18*b* while the operating part 64 attached to the armature 60 is inserted between the insulating wall 14*g* of the base housing 10 and the substantially rectangular plate 11. After the armature 60 has been installed, the assembly of the flat-plate-form yoke 40 and winding frame 50 is installed on the base housing 10. In this installation, the coil terminals 57 are inserted into the pair of through-holes 17 in the substantially rectangular plate 11, and the protrusion 42*a* of the flat-plate-form yoke 40 is inserted into the recess 16*c* of the base housing 10, while the extension-side guiding recess 52*d* of the winding frame 50 is guided by the rail 16*a* of the base housing 10, and the terminal-side guiding recess 53*a* is guided by the rail 16*b*. As shown in FIGS. 1 and 3, the protrusion 20 of the base housing 10 is positioned on the front side inside the recess 52*c* of the winding frame 50, so that a space is formed by the recess 52*c* and protrusion 20 that accommodates the rectangular projection 62*b* of the armature 60. As a result, the rectangular shaft portion 62*a* is supported in the recess 18*b*, and the rectangular projection 62*b* located on the axial line of the rectangular shaft portion 62*a* is supported inside a space defined by the recess 52*c* formed in the winding frame 50 and the protrusion 20 of the base housing 10.

With such a construction, the armature 60 can pivot about the rectangular shaft portion 62*a* and rectangular projection 62*b*. In this state, the armature 60 receives a spring force via the operating part 64 from the elastic spring 21*c* of the movable contact 21 that also acts as a return spring, and since the excitation coil 56 is in a non-excited state, the vertical portion 63 on the side of the second end of the armature 60 is separated from the second leg 43 of the flat-plate-form yoke 40. After the assembly of the flat-plate-form yoke 40 and winding frame 50 has been installed on the base housing 10, the case 70 is placed over these parts and assembly of the electromagnetic relay 1 is completed.

When the electromagnetic relay 1 is complete, as shown in FIG. 6, the insulating distance between the excitation coil 56 and the movable and fixed contacts 21 and 22 is the sum of the distance a between the front surface of the elastic spring 21*c* of the movable contact 21 and the front surface edge of the rectangular hole 15 formed in the front wall (the front, insulating wall) 14*b*, the distance b between the front surface edge and the rear corner edge of the operating part 34, the distance c between the rear corner edge and the front lower edge of the insulating wall 14*g*, the distance e between the above-mentioned front lower edge and the front upper edge of the insulating wall 14*g*, and the shortest distance f between the above-mentioned front upper edge and the surface of the excitation coil 56. If the insulating wall 14*g* and front wall 14*b* were not present, the insulating distance between the excitation coil 56 and the movable and fixed contacts 21 and 22 would be the shortest distance h between the elastic spring 21*c* of the movable contact 21 and the surface of the excitation coil 56, and would thus be shorter than the above-mentioned insulating distance.

Furthermore, as shown in FIG. 6, the insulating distance between the armature 60 and the movable and fixed contacts 21 and 22 is substantially equal to the sum of the above-mentioned distance a, the above-mentioned distance b, the above-mentioned distance c and the shortest distance d between the front corner edge of the operating part 34 and the armature 60. If the insulating wall 14*g* and front wall 14*b* were not present, the insulating distance between the armature 60 and the movable and fixed contacts 21 and 22 would be substantially equal to the sum of the distance g between the elastic spring 21*c* of the movable contact 21 and the rear corner edge of the operating part 64, the above-mentioned distance c and the above-mentioned distance d and would thus be shorter than the insulating distance in an electromagnetic relay in accordance with the invention as calculated above. As such, in an electromagnetic relay according to the present invention, the insulating distance between the primary side circuit consisting of the excitation coil 56 and armature 60 and the secondary side circuit consisting of the movable and fixed contacts 21 and 22 is increased in view of the presence of insulating walls formed in connection with the base housing 10 so that the withstand voltage can be increased.

Furthermore, the front wall 14*b* reduces the deterioration in the withstand voltage caused by conductive wear debris, etc., being scattered into the area surrounding the contact points 21*d* and 22*d* during opening and closing of the relay. Moreover, the front wall 14*b* also reduces the deterioration in the withstand voltage that results from wear debris from the contact points 21*d* and 22*d* being scattered so that the wear debris adheres to the armature 60, etc.

In addition, when assembly of the electromagnetic relay 1 has been completed, the rectangular shaft portion 62*a* of the armature 60 is supported in the recess 18*b*, and the rectangular projection 62*b* located on the axial line of the rectangular shaft portion 62*a* is supported in the space defined by the recess 52*c* formed in the winding frame 50 and the protrusion 20 of the base housing 10. The movement of the rectangular shaft portion 62*a* and rectangular projection 62*b* in the horizontal direction of the armature 60 and the forward-rearward direction perpendicular to the horizontal direction can be regulated. Accordingly, the pivoting axis of the armature 60 is stable, and the pivoting of the armature 60 is not affected by dimensional error or deformation of the base housing 10 or the case 70, so that the armature 60 can be smoothly pivoted.

An embodiment of the present invention is described above. However, the present invention is not limited to this embodiment; various alterations are possible.

For example, in the embodiment described above, the recess 18*b* that receives the rectangular shaft portion 62*a* of the armature 60 is formed in the base housing 10. However, it is not absolutely necessary that the part that receives the rectangular shaft portion 62*a* be recessed and a hole may also be used.

In the electromagnetic relay according to an embodiment described above, the base housing has a first insulating wall extending between the excitation coil and the armature, and has a second insulating wall blocking the space between the movable and fixed contacts and the armature. Furthermore, the operating part presses the movable contact via a hole that is formed in substantially the central portion of the second insulating wall. Accordingly, the insulating distance between the primary side circuit consisting of the excitation coil and the armature and the secondary side circuit consisting of the movable and fixed contacts can be increased, so that the withstand voltage can be increased.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electromagnetic relay comprising:

a substantially C-shaped yoke having a longitudinally extending body and first and second legs each extending vertically from a respective end of said body;

a winding frame having a winding body attached to said body of said yoke;

an excitation coil wound around said winding body;

an armature having a longitudinally extending portion, a pivoting shaft extending from one end of said longitudinally extending portion in a direction of extension of said first leg of said yoke, and a vertically extending portion extending from the other end of said longitudinally extending portion, said vertically extending portion being arranged to contact said second leg of said yoke when said excitation coil is excited;

an insulating operating part arranged on said longitudinally extending portion of said armature;

an insulating base housing arranged to support said first and second legs of said yoke, said base housing including a first insulating wall arranged between said excitation coil and said armature; and a movable contact and a fixed contact attached to said base housing, said movable contact and said fixed contact being arranged under said excitation coil and at least partially between said first and second legs of said yoke, said movable contact and said fixed contact being arranged to contact each other upon exertion of pressure by said operating part, said base housing including a second insulating wall arranged between said movable and fixed contacts and said armature, said second insulating wall including a hole in a substantially central portion, said operating part being arranged to press said movable contact via said hole in said second insulating wall.

2. The electromagnetic relay of claim 1, wherein said pivoting shaft of said armature has a lower end having a shaft portion formed thereon and said base housing includes a cavity arranged to receive said shaft portion of said pivoting shaft of said armature.

3. The electromagnetic relay of claim 2, wherein said cavity of said base housing comprises a recess.

4. The electromagnetic relay of claim 2, wherein said cavity of said base housing comprises a hole.

5. The electromagnetic relay of claim 1, wherein said first insulating wall is arranged between said longitudinally extending portion of said armature and said excitation coil.

6. The electromagnetic relay of claim 1, wherein said base housing includes a front wall and an extension wall extending perpendicular to said front wall, said first insulating wall being integral with said extension wall.

7. The electromagnetic relay of claim 6, wherein said second insulating wall constitutes a rear wall of said base housing and is parallel to said front wall, said extension wall extending between said front wall and said second insulating wall.

8. The electromagnetic relay of claim 6, wherein said first insulating wall extends forward of said front wall.

9. The electromagnetic relay of claim 1, wherein said hole in said second insulating wall is rectangular.

10. The electromagnetic relay of claim 1, wherein said first and second legs extend downward from said body of said yoke.

* * * * *